US010441063B2

(12) United States Patent
Pollack et al.

(10) Patent No.: US 10,441,063 B2
(45) Date of Patent: Oct. 15, 2019

(54) SPIN AND TWIST RESISTANT CLIP AND BADGE HOLDER AND LANYARD ASSEMBLY

(71) Applicant: CCL Label, Inc., Framingham, MA (US)

(72) Inventors: Karen Patricia Pollack, Madison, WI (US); Matt Aaron Nick, Madison, WI (US); Bryan Martin Shova, Chicago, IL (US); Steven Wade Hamblin, Daleville, VA (US); Katlyn Garcia, McFarland, WI (US); Lizzi Alstad, Madison, WI (US)

(73) Assignee: CCL LABEL, INC., Framingham, MA (US)

( * ) Notice: Subject to any disclaimer, the term of this patent is extended or adjusted under 35 U.S.C. 154(b) by 0 days.

(21) Appl. No.: 15/636,219

(22) Filed: Jun. 28, 2017

(65) Prior Publication Data

US 2018/0020813 A1 Jan. 25, 2018

Related U.S. Application Data

(60) Provisional application No. 62/480,742, filed on Apr. 3, 2017, provisional application No. 62/365,790, filed on Jul. 22, 2016.

(51) Int. Cl.
*A45F 5/00* (2006.01)
*G09F 3/14* (2006.01)
(Continued)

(52) U.S. Cl.
CPC ..... *A45F 5/00* (2013.01); *G09F 3/14* (2013.01); *G09F 3/207* (2013.01); *A44B 11/006* (2013.01);
(Continued)

(58) Field of Classification Search
CPC . A45F 2005/006; A44B 11/006; G09F 3/207; G09F 3/14
See application file for complete search history.

(56) References Cited

U.S. PATENT DOCUMENTS 2,766,500 A * 10/1956 Chanko ..... G02C 3/006 24/265 R
5,027,477 A 7/1991 Seron
(Continued)

FOREIGN PATENT DOCUMENTS

EP 86117747.5 1/1987
EP 0227063 7/1987
(Continued)

*Primary Examiner* — Adam J Waggenspack
(74) *Attorney, Agent, or Firm* — McDonald Hopkins LLC

(57) ABSTRACT

The inventive assembly incorporates a lanyard assembly that may, in some embodiments, be attachable to badge connector to present a single, unitary connector with a stylized appearance. The ends of the lanyard ribbons are engaged in a manner that creates free space between the edges of the ribbon immediately upon exiting the connector assembly so as to impart resistance to unwanted twisting of the object held by the lanyard assembly and/or the ribbon forming part of it. The object or badge connector associated with the assembly comprises a clip, j-hook, or key ring assembly for easy attachment of a card or card holder.

10 Claims, 10 Drawing Sheets

(51) Int. Cl.
*G09F 3/20* (2006.01)
*A45C 11/18* (2006.01)
*A44B 11/00* (2006.01)

(52) U.S. Cl.
CPC ..... *A45C 11/182* (2013.01); *A45F 2005/006* (2013.01)

(56) References Cited

U.S. PATENT DOCUMENTS

| | | | | |
|---|---|---|---|---|
| 5,893,198 | A | 4/1999 | DeCotis | |
| 6,711,785 | B1 * | 3/2004 | Hicks | A44B 11/006 24/3.1 |
| 2003/0033697 | A1 | 2/2003 | Hicks et al. | |
| 2005/0178614 | A1 * | 8/2005 | Brosofsky | A45F 5/00 182/5 |
| 2009/0255095 | A1 | 10/2009 | Gillard et al. | |
| 2014/0173858 | A1 * | 6/2014 | Wu | A44B 11/006 24/586.11 |

FOREIGN PATENT DOCUMENTS

| | | |
|---|---|---|
| JP | 19970366911 | 7/1999 |
| JP | H11 192110 | 7/1999 |

* cited by examiner

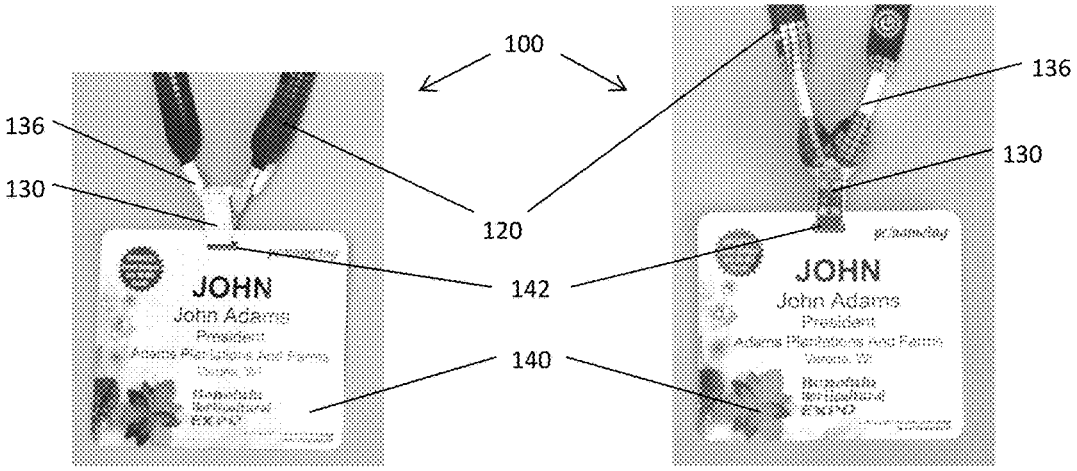
FIGURE 3A
FIGURE 3B
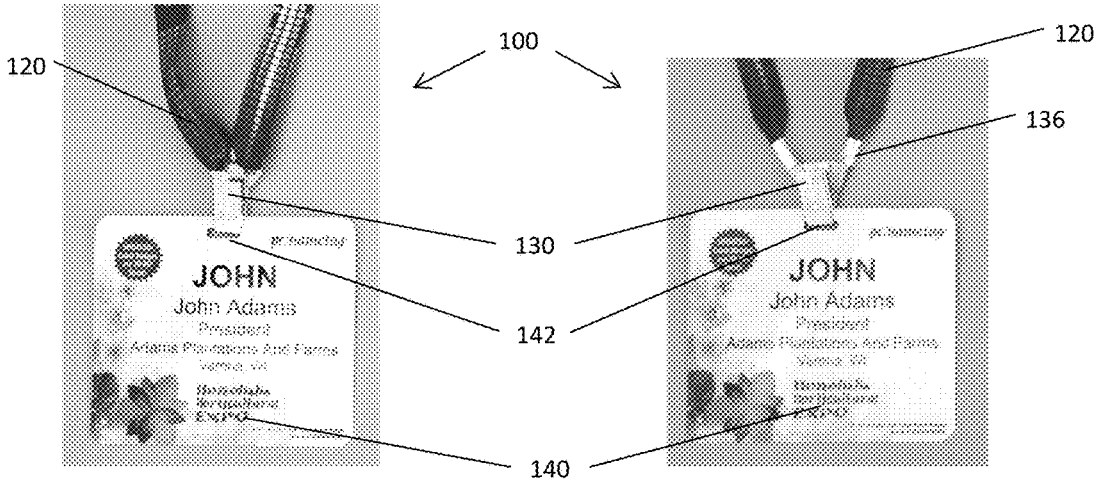
FIGURE 3C
FIGURE 3D

SPIN AND TWIST RESISTANT CLIP AND BADGE HOLDER AND LANYARD ASSEMBLY

RELATED APPLICATIONS

This application claims priority to, and all benefits from, U.S. provisional patent application Ser. No. 62/365,790 filed on Jul. 22, 2016 and U.S. provisional patent application Ser. No. 62/480,742 filed on Apr. 3, 2017.

TECHNICAL FIELD

The present invention relates generally to an assembly for holding and displaying name badges and, more specifically, to a spin and/or twist resistant assembly incorporating a clip and lanyard-style connector assembly.

BACKGROUND

Lanyards with attached badges having identifying information are well known and in widespread use in an array of entertainment, meetings, and employment settings. Such identification means are convenient owing to the ease with which the ribbon of the lanyard may be slipped over and removed from the user's neck without the need to manipulate a pin or clasp. In turn, a badge holder receives or attaches to a card containing printed indicia.

A variety of known lanyard-style badge holders 10 are shown in FIGS. 1A through 1C. A single ribbon 20 is attached at both ends to a connector 30. The optional connector 30 attaches to a clip 32 to engage card 40 via preformed slots 42 or, as seen in FIG. 1D, the clip 32 itself may include an aperture to serve as a connection point to ribbon 20. In some embodiments, ferrule 34 is required to gather the ribbon ends into a single entity prior to attaching to the connector 30.

U.S. Pat. Nos. 5,027,477 and 6,711,785 depict lanyards attachable to a badge, wherein the ribbon ends are held at a single point in the connector. United States Patent Publication 2014/0173858 shows a similar type of multi-purpose fastener.

One drawback to these prior art and patented designs relying on a single connector and clip is that the ribbon tends to become twisted and/or spun around itself easily, especially in situations where the wearer may be leaning forward (or otherwise in a body position) that allows the badge and lanyard to dangle freely. In turn, this may lead to the badge holder flipping over entirely, so as to obscure the printed indicia and defeat the purpose of the assembly as an identification means. Another drawback is the ferrules, like freely spinning eyelets provided in some connectors to combat spinning and twisting, tend to add complexity and cost to manufacturing operations.

In addition, also as seen in FIG. 1D, a pair of clips 32 (with an optional connector, not shown) may separately engage slots 42. While this arrangement is more effective at maintaining the outward orientation of card 40, it effectively doubles the materials, and costs in comparison to the other prior art embodiments. Further, users may find the requirement to attach the card at two separate points to be time consuming and, aesthetically, users may find the two separate attachment points to be less attractive than a single, unitary connector.

Another drawback to all of the foregoing designs is that they require attachments or mechanisms to hold the badge at the distal end of the lanyard connector assembly body. Users may find such downward projecting appendages undesirably long and/or unsightly.

SUMMARY

In view of these shortcomings, a system and method that resists flipping and twisting would be welcome. A combination lanyard connector and badge holder that conceals the attachment mechanism for the badge holder and/or that possesses an attractive outward facing for the lanyard connection is also needed.

The inventive assembly incorporates a lanyard assembly that may, in some embodiments, be attached and concealed on an inner facing to badge or object connector. The combination presents a single, unitary connector with a stylized appearance, preferably trapezoidal in shape. In some embodiments, the overall assembly has a snap-fit body which captures opposite ends of a lanyard ribbon in a manner that creates an angle and free space between the edges of the ribbon immediately upon exiting the connector assembly. The badge or object connection may be formed integrally with the lanyard connector or attached so as to be concealed (either partially or completely) behind the outward facing side. The badge or object connector itself may be a clip, j-hook, or key ring assembly for easy attachment of a card or other object.

In one aspect, the invention may comprise any combination of the following features:

- a first half shell member having a pair of tapering sidewalls terminating in a pair of shoulders defining a lanyard opening across a top edge of the first half shell member;
- a second half shell member having a pair of engagement posts defining a lanyard opening across a top edge of the second half shell member;
- wherein the first and second half shell members engage in a snap-fitted connection to form a lanyard assembly in which the engagement posts are captured by at least one of the sidewalls to form an angled guide slot for opposing ends of a lanyard ribbon;
- wherein gripping cones formed on at least one of the first half shell member and the second half shell member capture the lanyard ribbon when the first and second half shell members are engaged;
- wherein opposing ends of the lanyard ribbon extend out of the lanyard opening in a non-overlapping, angled relationship;
- wherein the angled guide slots are defined by inner facings of the shoulders and engagement posts on opposing sides of the lanyard opening;
- wherein the non-overlapping, angle formed by the opposing ends of the lanyard ribbon is at least 5 degrees;
- wherein the angle is 20 degrees;
- at least one transverse support wall disposed across a middle portion on either the first half shell member and the second half shell member and at least one corresponding groove to receive the transverse support wall formed on the other of the first half shell and the second half shell;
- wherein at least one transverse support wall is parallel to the top edge of the first half shell member and/or the second half shell member;
- wherein at least one transverse support wall adjoins the sidewalls to define an upper chamber and a lower chamber of the lanyard assembly, wherein the lanyard ribbon is retained within the upper chamber;

wherein the transverse support wall is formed on the first half shell member and the corresponding groove is formed on the second half shell member;

an object connector mechanism connected with at least one of the first and second half shell members;

wherein the object connector mechanism is selected from a bulldog clip, a j-hook clip, a D-ring, a pin, and a key ring;

wherein the object connector protrudes at least partially through an aperture formed on a rear of the lanyard assembly; and wherein the object connector is formed completely on an exterior, rear facing side of the lanyard assembly.

Another embodiment may comprise any combination of the following:

a substantially flat, central body having a major front-facing surface and an opposing rear-facing surface;

a pair of engagement mechanisms positioned immediately adjacent one another at a single point along a top edge of the flat central body;

a connector mechanism attached to either the front- or rear-facing surface;

a badge assembly attached to the connector mechanism at a single point;

wherein the adjacent engagement mechanisms each attach to separate ends of a lanyard ribbon so that the ends are spaced apart and the respective ribbon sections immediately adjacent to where each end is attached are not parallel;

wherein the single point comprises a slot formed in the badge assembly;

wherein the respective ribbon sections immediately adjacent to where each end is attached form an angle greater than 5°;

wherein the angle is 20°;

wherein the engagement mechanisms are a pair of apertures sharing an common divider;

wherein the apertures are formed as slots;

wherein the apertures include a curvilinear interior edge;

wherein the engagement mechanisms are a pair of arm extensions formed in a Y-shape; and wherein at least one of the arm extensions forms a crimped connection with the lanyard ribbon.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any written information in the drawings should be treated as part of this disclosure. In the same manner, the relative positioning and relationship of the components as shown in these drawings, as well as their function, shape, dimensions, and appearance, may all further inform certain aspects of the invention as if fully rewritten herein.

In the drawings:

FIGS. 3A through 3F are front plan, sectional views of various embodiments of lanyard-badge connector assemblies with bulldog lanyard attachments.

FIG. 7C are perspective views of the rear facing side of a trapezoidal lanyard assembly having different card or object connector mechanisms according to certain embodiments, while

DETAILED DESCRIPTION

Figure 1A:
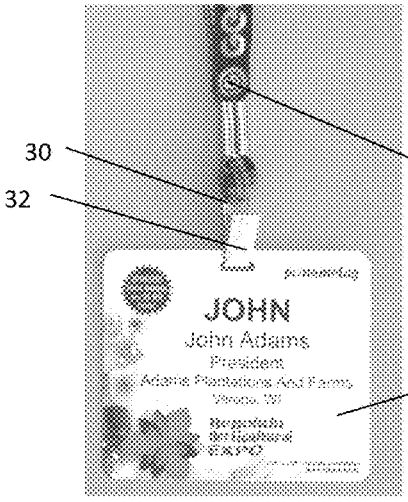
PRIOR ART FIGURE 1A
FIGS. 1A, 1B, and 1C are front plan sectional views of prior art lanyard attachments that are prone to twisting and flipping.
Figure 1B:
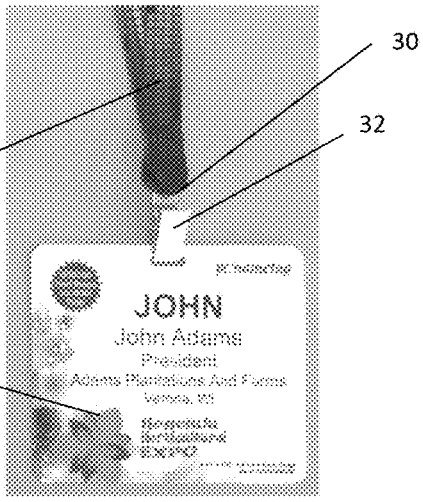
PRIOR ART FIGURE 1B
Figure 1C:
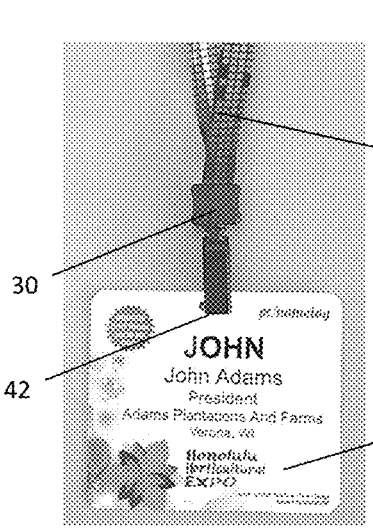
PRIOR ART FIGURE 1C
Figure 1D:
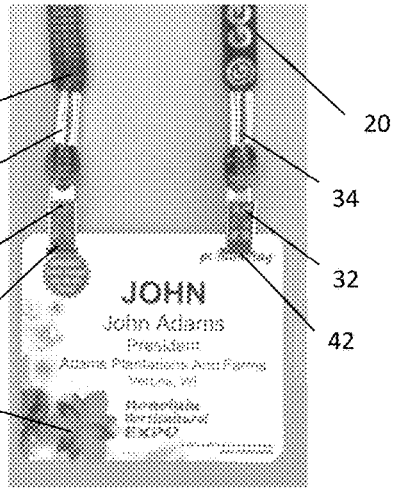
PRIOR ART FIGURE 1D
FIG. 1D is a front plan sectional view of a prior art lanyard attachment relying on two clips engaging the card to provide resistance to twisting and flipping.
Figure 2A:
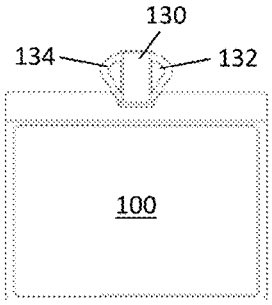
FIGS. 2A through 2L are front plan, sectional views of various embodiments of the connector assembly in combination with a bulldog lanyard attachment.
Figure 2B:
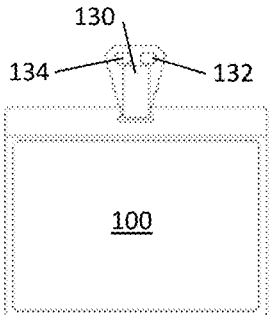
Figure 2C:
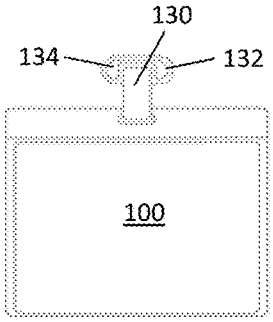
Figure 2D:
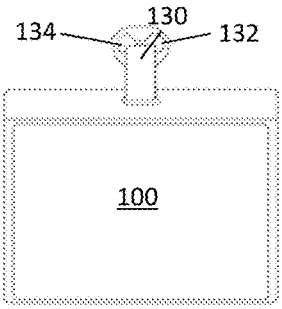
Figure 2E:
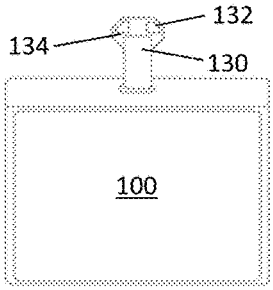
Figure 2F:
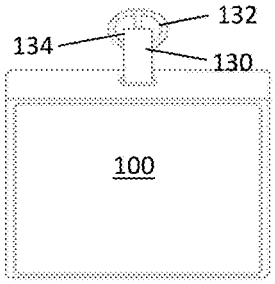
Figure 2G:
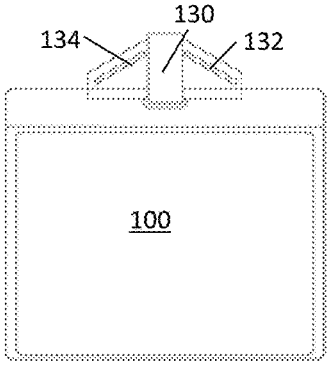
Figure 2H:
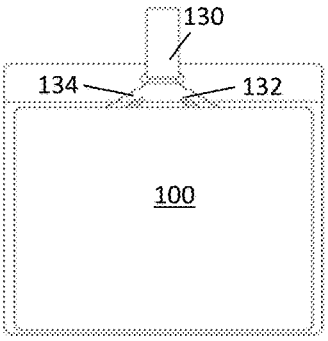
Figure 2I:
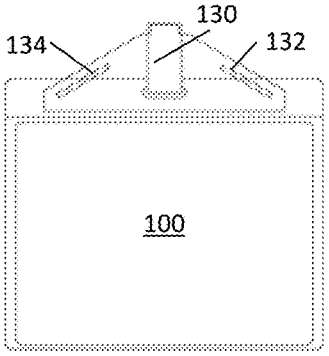
Figure 2J:
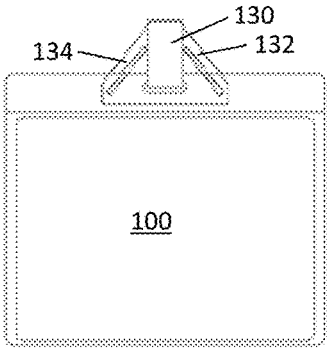
Figure 2K:
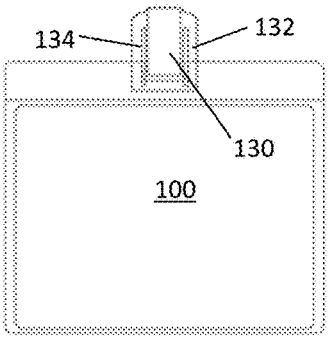
Figure 2L:
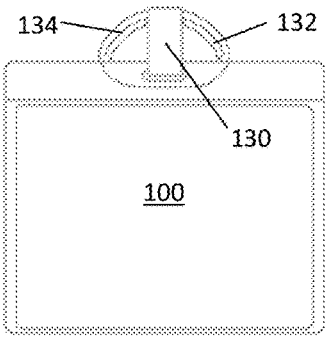
Figures 3E, 3F:
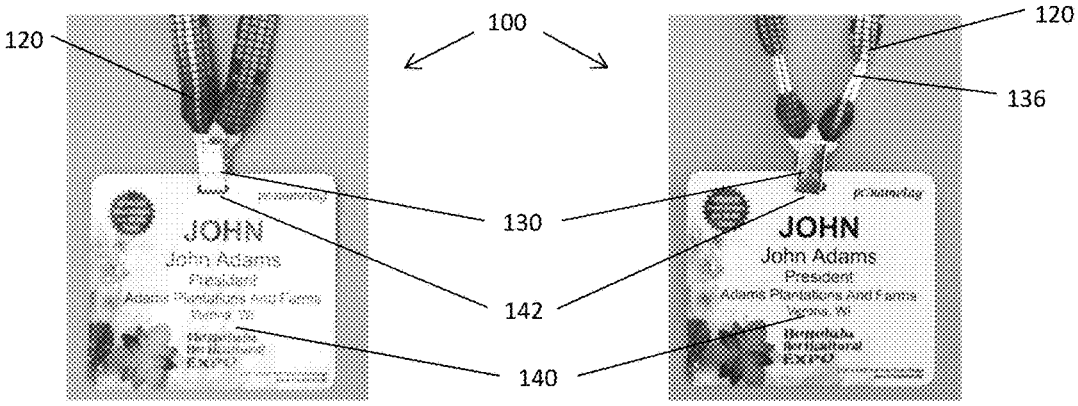
Figure 4A:
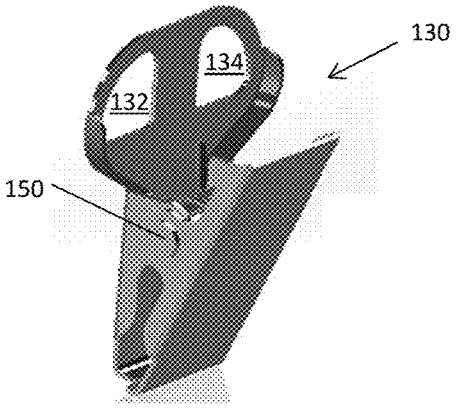
FIGS. 4A through 4C are three dimensional views, rotated at various angles, of the connector according to the embodiment shown in FIG. 2E.
Figure 4B:
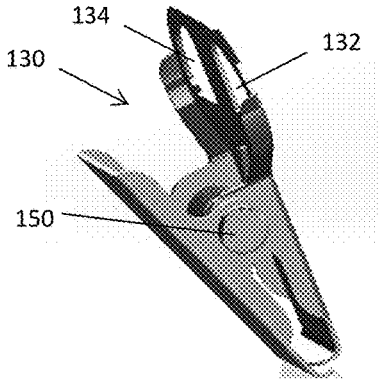
Figure 4C:
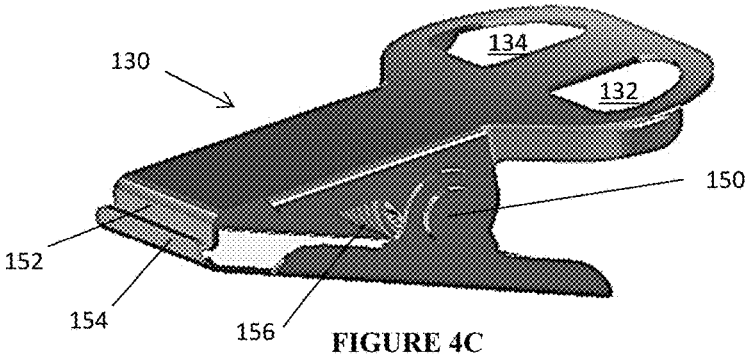
Figure 5A:
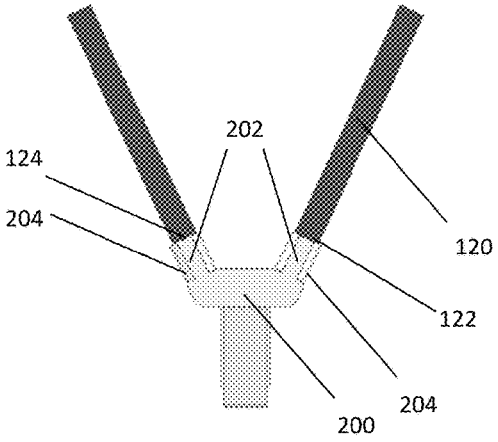
FIGS. 5A and 5B a front plan, sectional views of a crimped arm embodiment of the lanyard-badge connector assemblies.
Figure 5B:
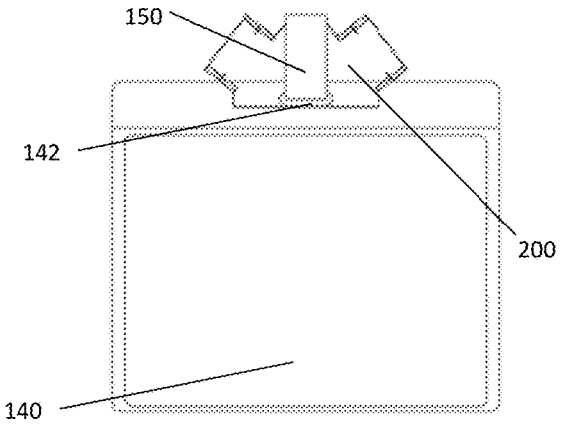
Figure 5C:
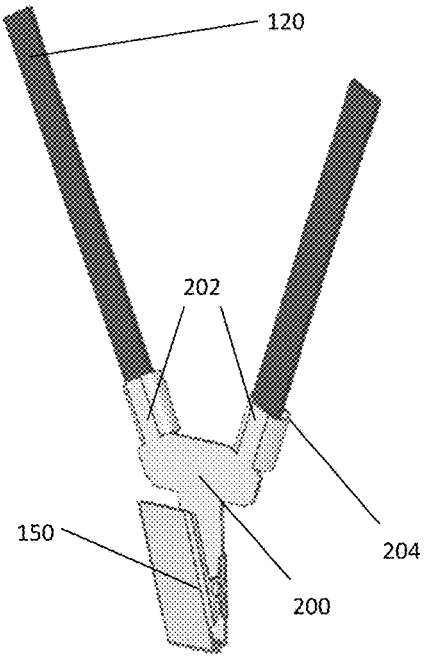
FIGS. 5C and 5D are perspective sectional views of FIGS. 5A and 5B, respectively speaking.
Figure 5D:
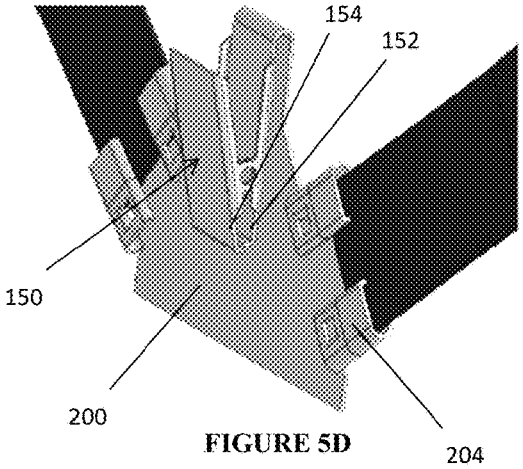

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise. Unless expressly stated or clearly indicated from the context herein, references to a badge and/or badge holder may encompass any number of items commonly attached to or held by lanyards, including but not limited to identification and/or key cards, event tickets and/or credentials, key rings, and the like.

With references to FIGS. 2A through 4C, various embodiments of the lanyard assembly 100 are shown. Generally speaking, assembly 100 includes a looped attachment 130 comprising a pair of integrally formed apertures 132, 134. A lanyard ribbon 120 (not shown in any of FIGS. 2A through 2L) engages the assembly by having separate ends threaded through the apertures 132, 134. Optional ferrules 136 can be used to gather and manage the width of the ribbon.

The ends are threaded through apertures 132, 134 and the then tied or secured back on to the ribbon 120 by way of adhesive, ferrules, or other fasteners. In other embodiments, the ribbon 120 may be threaded through both apertures 132, 34 and then separate secured (e.g., tied or fastened).

This arrangement ensures that separation is created between the ends, as well as the embodiments in FIGS. 5A through 5D where both angle and separation are provided between ends 122, 124. In all embodiments, the separate ends of ribbon 120 immediately extending upward and outward from the connector (be it attachment mechanism 130, body 200, or body 300) create an angle relative to one another. In addition, these ends do not overlap and, instead, spacing exists between the end 122 and the end 124. The angle between the ends is at least 5°, more preferably 20°, and could be as much as 90° or even 120°. Additional whole integers falling between these maximum and minimum are also contemplated and expressly disclosed herein (e.g., 10°, 15°, 25°, etc.).

Additionally or alternatively, the angle associated with the invention can be measured individually at each ribbon end relative to the horizontal axis, which is parallel to the top edge of a card 140 held in the assembly in its natural, upright position. In this instance, the angles are preferably mirror-images, although they could be different. Thus, the angle in created between the ribbon end and the horizon may be as little as 5° and as great as 87.5°, with preferred embodiments having 45° and 80° orientations. As before, any whole integer between these upper and lower limits is contemplated and expressly disclosed, and it will be appreciated that the ends attach at separate but non-parallel points so as to leave spacing between the ribbon ends as it extends away from the assembly.

One or both apertures 132, 134 may be formed as linear slots, thereby defining yet another angle that is effectively inversely proportional to that made by the ribbon ends themselves. If the apertures 132, 134 are curved and/or or present a curvilinear edge along the top where the ribbon is engaged, a tangent may be drawn across the midpoint of the curve in order to define the angles described above. The lines or tangents converge to define an acute angle that is no greater than 175°, more preferably 160°, and could be as small as 90°, 45°, or even 5°.

Notably, the apertures 132, 134 may share a common boundary or divider so as to allow engagement of the lanyard ribbon at a single, central location while still maintaining the requisite non-overlap/spacing between the ribbon ends. More specifically, this arrangement enables use of a badge connector that allows for the quick and easy attachment and alteration of the badge at a single point. It should also be noted that all embodiments require the ribbon ends to be physically spaced apart from one another as they exit and extend upward away from the connector body.

Without wishing to be confined by any theory of operation, it is believed that the combination of spacing the ribbon 120 and providing the aforementioned angles imparts sufficient rigidity to the overall assembly 100 so as to make it difficult to twist the ribbon ends 122, 124 around themselves. Similarly, the badge 140 is secured via a bulldog clip 150 or other attachment means (described below) so as to prevent spinning, rotation, or twisting at the connection between the assembly 100 and the badge 140 itself. Further, the profile of the assembly, in combination with gravity, urges the generally flat surface of the assembly against the user's body, both for comfort and to further facilitate the resistance to twisting, flipping, and rotation.

A bulldog clip 150 is integrated with connector mechanism 130 and, in other embodiments, may be similar formed from or attached to the lanyard connector, the central body, or other components. In some embodiments, clip 150 may be affixed by adhesive, fasteners, or a snap fit. The clip 150 includes first and second jaws 152, 154. A flange 156 may extend in a generally orthogonal direction from one or both jaws 152, 154 to engage and/or extend through a slot 142 formed in the badge 140. One or more biasing members, such as a torsion spring, are positioned between or integrated with jaws 152, 154 so as to keep the badge securely affixed. A cooperating slot 140 in a badge or badge holder should be sufficiently elongated so as to avoid its rotation or spin relative to the connector 130.

The clip 150 may be positioned at any point on the connector 130, the body 200, or the half shell members (described below), thereby allowing for it to be concealed when positioned in the upper portion of the assembly or partially exposed when positioned on lower portion extremities. Preferably, one of the jaws 152, 154 is integrally formed as part of the body 200. In any event, the bulldog clip affixed in a central portion of the body 200 so as to allow the spring to depressed and rotate in a direction that is orthogonal to the general direction of the ribbon and the planar surface of the body 200 itself.

In FIGS. 5A through 5D, connection with the lanyard ribbon 120 is made by way of arms 202. Arms 202 extend upward from a central body 200 and engage ribbon ends 122, 124. The arms 202 are spaced apart and provided relative to one another so as to incorporate the various angles described above. Crimping flanges 204 are integrated along the edges of each arm 202. When the ribbon 120 is positioned, the flanges 204 are bent to secure the ribbon 120. Adhesive or other fasteners (e.g., rivets, screws, etc.) can also be incorporated in this and other embodiments to further secure the ribbon 120.

Figure 6A:
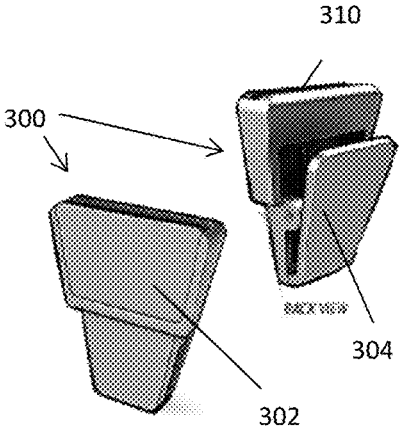
FIGS. 6A through 6D are front and back perspective views of trapezoidal lanyard and badge/item connectors.
Figure 6B:
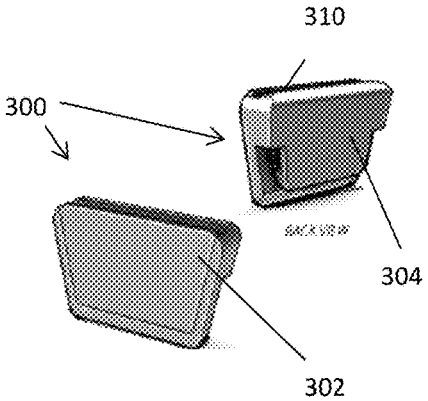
Figure 6C:
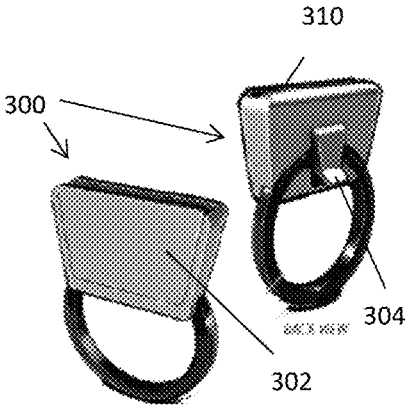
Figure 6D:
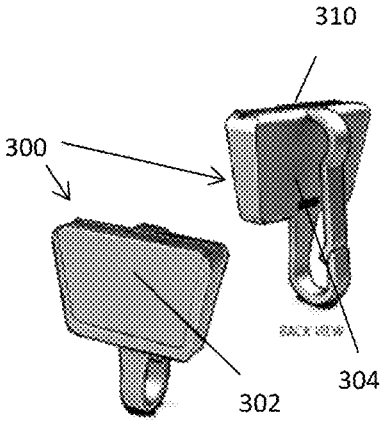

With respect to FIGS. 6A-6D (with each figure individually showing perspective front and back views), another embodiment of the inventive landyard-badge assembly is shown. Here, trapezoidal body 300 includes a front facing side 302 and a rear facing side 304 that includes any number of connection mechanisms integrated with or mated to the body 300 in order to attach a badge or other item. These mechanisms may include a bulldog clip (FIG. 6A), a universal, hidden clip (FIG. 6B), a key ring connector (FIG. 6C), and j-hook (FIG. 6D). In each instance, ribbon (not shown) is received within a slot 310 formed along the top (i.e., the widest part of the trapezoid). Side 302 is generally flat so as to accommodate artwork or other ornamental design elements. Side 304 may include a recessed portion so that the profile of the connection mechanism against the user's body is as flat and comfortable as possible.

Figure 7A:
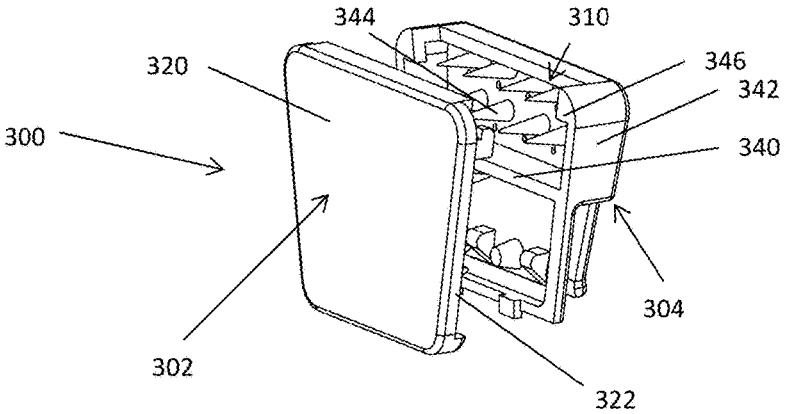
FIG. 7A is a, exploded, perspective view of the multi-piece, trapezoidal lanyard assembly.
Figure 7B:
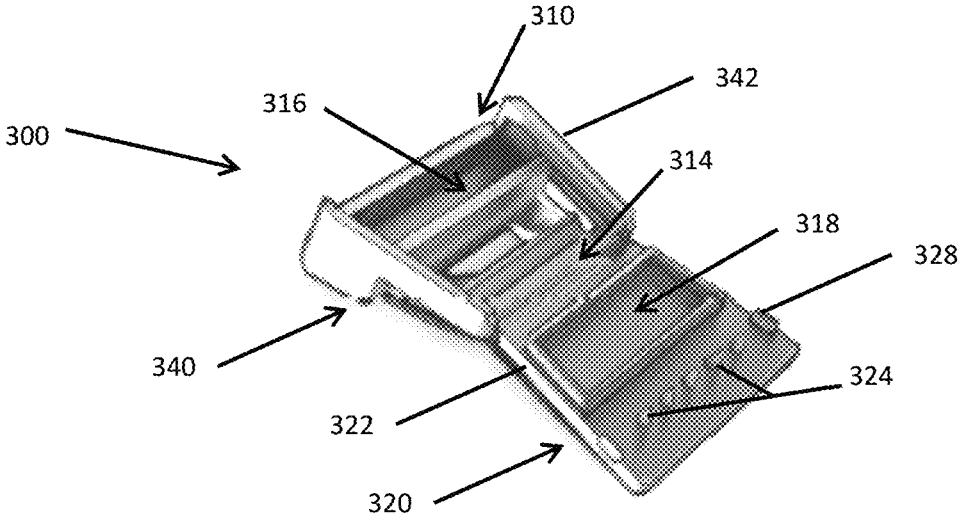
FIG. 7B is a perspective view of a clam-shell, trapezoidal lanyard assembly.

The trapezoidal shape of body 300 lends itself to a two piece arrangement as shown in FIGS. 7A through 7D. Generally speaking, body 300 is formed from two separate "half shell" members 320, 340. Members 320, 340 are formed to create a snap-fit connection, although the additional or alternative use of adhesives or conventional fasteners is possible. An optional hinge 314, as shown in FIG. 7B, may establish a connection between pieces 320, 340, thereby forming a "clam shell" style unitary member. A further friction or conesed insert (not shown) could be provided in a cavity 316 at or near slot 310 on one or both of the pieces 320, 340 to further facilitate engagement of the ribbon.

Figure 7C:
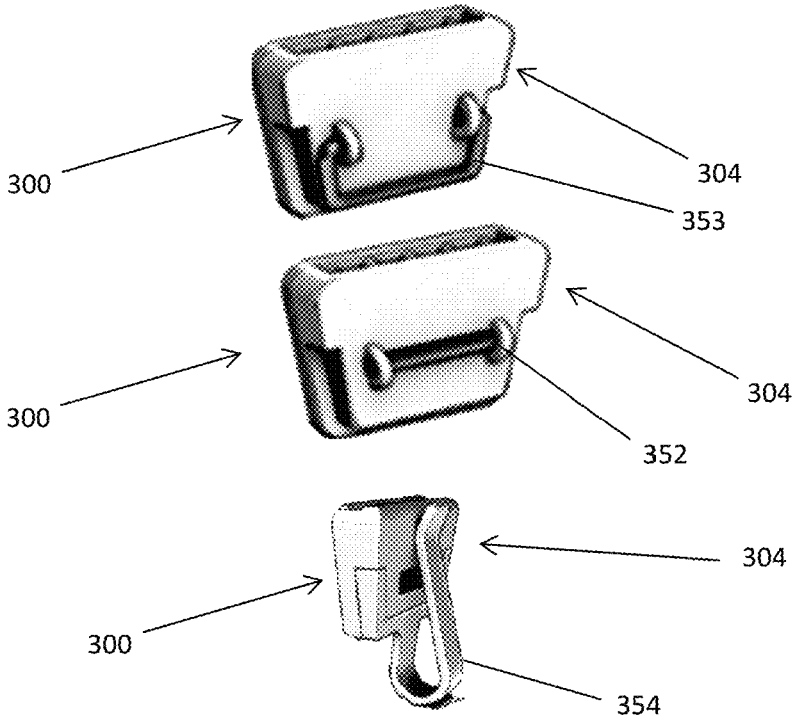
Figure 7D:
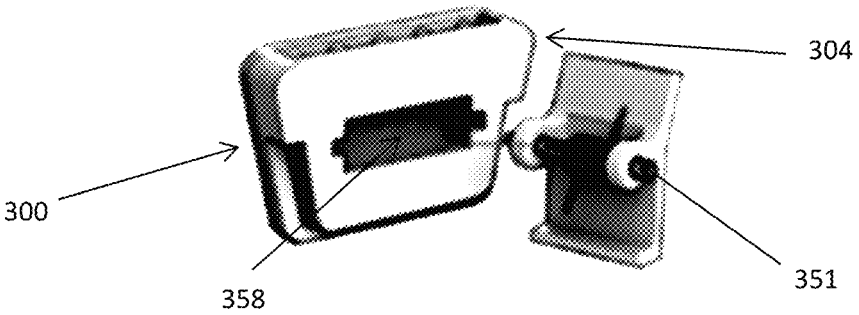
FIG. 7D is a similar perspective view but with the bulldog connector shown in a partially exploded manner to illustrate embodiments in which the connector mechanism protrudes through an opening in the body of the assembly.

In any of these arrangements, the multi-piece construction of body 300 allows for the opposing ends of a lanyard ribbon (not shown) to be placed into the connector body 300 to form the no-twist lanyard assembly. Here, the angle of the side walls 322, 342 of the half shells 320, 340 serve as edge guides to establish the proper spacing and angle of the lanyard ends noted above. Thus, in addition to providing an aesthetic, the trapezoidal shape of body 300 allows for the easy alignment of the lanyard ribbon ends in a manner that imparts twist resistant functionality. A separate cavity or void 318 created when pieces 320, 340 are fitted together may spatially accommodate any of the various card or object connectors. These connectors may include bulldog clip 351, a pin (or removable dowel) 352, D-ring (or complete key-ring/O-ring) 353, j-hook 354, as described elsewhere herein. FIG. 7C illustrates embodiments in which such connectors protrude partially out of the rear facing 304, including some embodiments where an access slot 358 is formed on a portion of one or both members 320, 340 for the bulldog clip 351 embodiment shown in partially exploded view of FIG. 7D. Further, protrusions 359 may help to secure these connectors within the body 300.

Ribbon-engaging cones 324, 344 (and/or other friction-enhancing surfaces) may be formed on the inner facings of the members 320, 340. Cones 322, 342 grip and engage the ribbon inserted into the body 300. As noted above, these cones or surfaces may be integrally formed as part of the member 320, 340, or they can be separately inserted, adhered or fastened to, or otherwise captured within the body 300 when pieces 320, 340 are attached together.

Figure 8A:
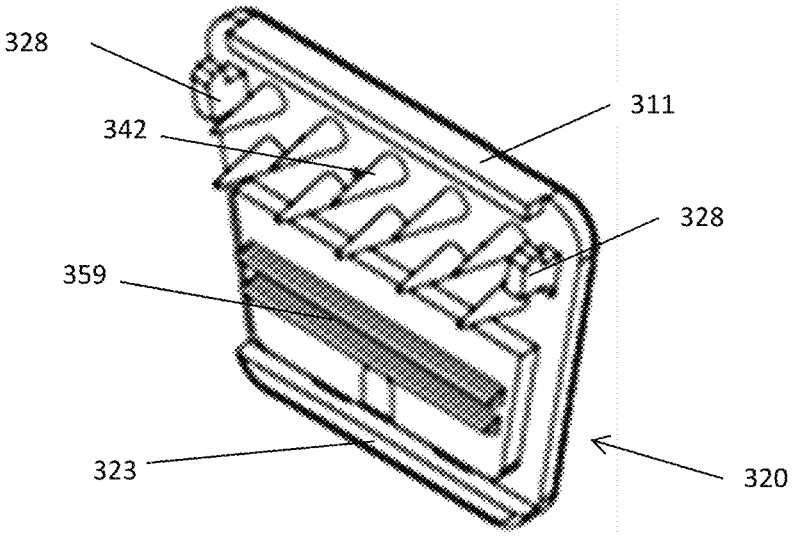
FIGS. 8A and 8B are perspective views of cooperating half shell members according to certain aspects of the trapezoidal lanyard assembly.
Figure 8B:
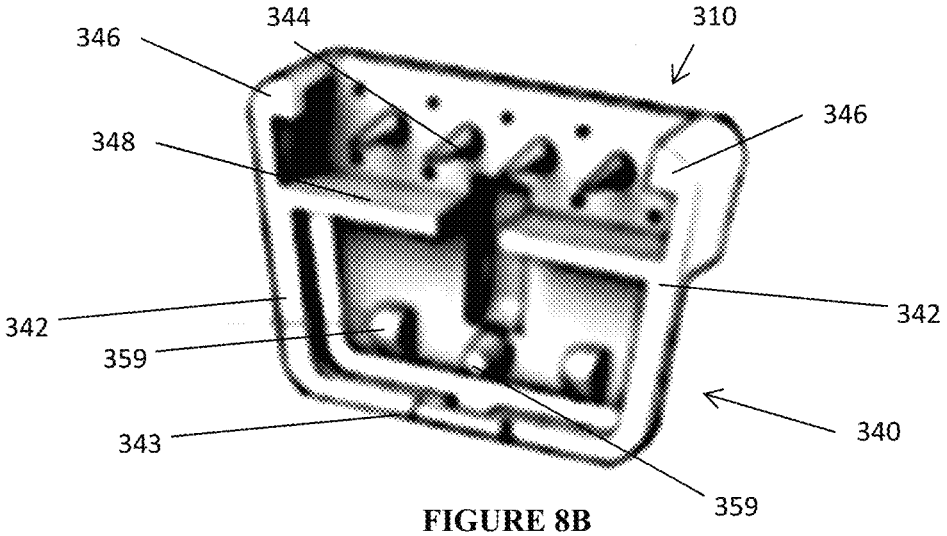

Attachment of members 320, 340 may be accomplished by way of cooperating shoulders 346 and posts 328, as seen in FIGS. 8A and 8B. The shoulders 346 may be formed on, in, or proximate to the sidewalls 342 of one half shell 340, with posts 328 formed on the adjacent body 320. In the alternative, posts 328 could be formed on member 340, with shoulders 346 on member 320. In some embodiments, posts 328 and shoulders 346 define opposing ends of the slot 310. Posts 328 and shoulders 346 can also define the angle at which the lanyard ribbon is received and positioned within the body 300. While only a pair of posts 328 and shoulders 346 are illustrated, any appropriate number may be used at any appropriate point on members 320, 340.

An additional transverse wall or divider 348 (relative to the orientation of the top slot 310 and bottom edge 323) may bisect member 340 to provide structural support and/or to better define the cavity for engaging the lanyard ribbon from the cavity devoted to the connector mechanisms 351, 352, 353, 354, etc., while a similar or replacement divider could be formed on member 320. A plurality of dividers or support walls could be provided, and they may nest in corresponding grooves on the opposing half shell member to facilitate connection of the pieces. An optional top edge or lip 311 may also be provided on one or both members 320, 340 along the top edge to better define the slot 310 when the members 320, 340 are fitted together.

Also, as seen in the combination of FIGS. 8A and 8B, it may be possible to rely only one member 320, 340 to fully form the necessary sidewalls for the body 300 (i.e., in FIG. 8A, sidewalls 322 have been omitted in favor of sidewalls 342 formed on the cooperating half shell 340 of FIG. 8B). To provide structure support, aesthetic continuity, and the like, bottom walls 323, 343 may connect the sidewalls on one or both members 320, 340. Alternatively, a slot may permit a card or badge holder to be inserted along the bottom edge, with protrusions 359 (e.g., rubberized fins or teeth) engaging the surface thereof to prevent rotation or slippage. Additional protrusions 359 (e.g., half cones or bumps) may be formed in the lower cavity to engage or attach to the clip or card/object connector mechanism.

Figure 9A:
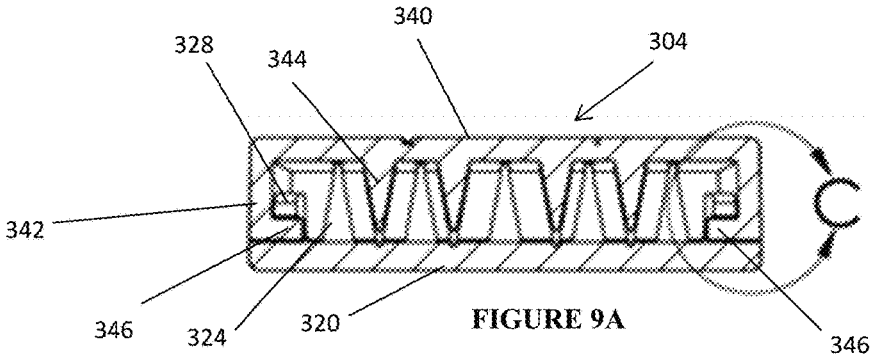
FIG. 9A is a cross sectional view taken along the top edge of the trapezoidal lanyard assembly, with FIG. 9B serving as a sectional view of area C defined in FIG. 9A.
Figure 9B:
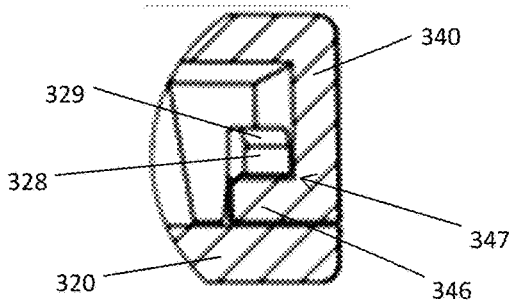
Figure 10A:
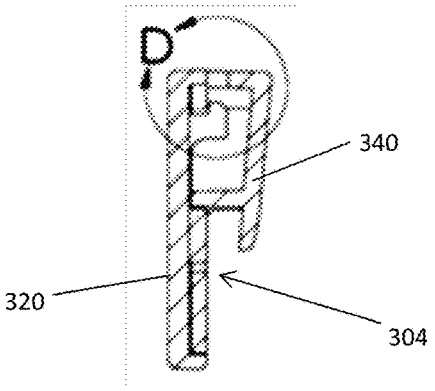
FIG. 10A is a cross sectional view taken along the side wall edge of the trapezoidal lanyard assembly, with FIG. 10B serving as a sectional view of area D defined in FIG. 10A.
Figure 10B:
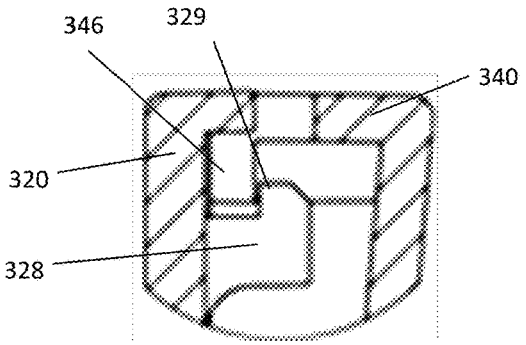

As best seen in the cross sectional views in FIGS. 9A and 9B, the cones 324, 344 are offset on each of the half shells 320, 340. In the same manner, posts 328 may include a cooperating flange 329 that secures around an indent 347 on the corresponding shoulder 346. Similarly, FIGS. 10A and 10B show similar views, except that images of the cones have been omitted for the sake of clarity. Also, in FIG. 10A, the bottom or lower portion of the body 300 is flattened so as to allow for incorporation of a connector mechanism on the exterior rear facing 304 of the body 300.

Figure 11:
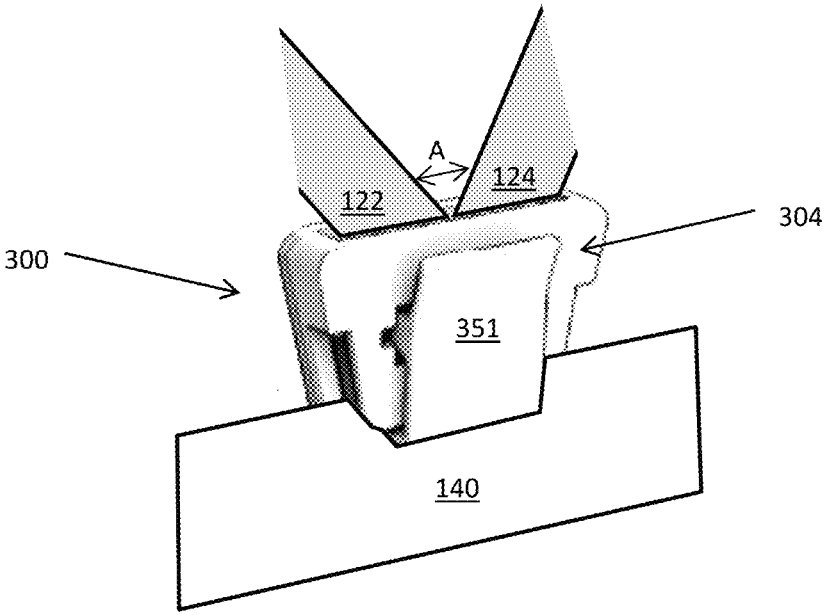
FIG. 11 is a perspective view of the rear facing of the trapezoidal lanyard assembly including a bulldog clip that is engaged with a card.

As previously noted and further illustrated in FIG. 11, the sides of trapezoidal lanyard assembly 300 are angled, each preferably at about 45°, 90°, 100°, or 120° relative to the top and/or bottom edges (which should be roughly parallel to one another), with the interior edges effectively guiding the ribbon ends 122, 124 as described above. Thus, the ribbon ends exiting the connector body will be spaced apart by distance A, so that the lanyard ribbon cannot become inadvertently tangled upon itself or twisted about itself, also as described above. Further, the exterior facing of the body itself may be textured (e.g., knurled, indented, etc.), embossed, polished (e.g., matte or gloss finish), and/or patterned (e.g., wavy, lined, cross-hatched, etc.). Owing to the concealment of ends 122, 124, generally presents a more attractive finish to the assembly 300. Any number of designs, emblems, logos, or printed indicia may appear on one or both of the major exterior surfaces of the body 300, while one or more the cards 140 (or badge holders or other object affixed by way of connector mechanism) may be freely attached and replaced to the assembly.

In some embodiments, the connection mechanism may also be by way of appropriate tabs and receiving apertures to create a snap fitting. Fasteners, adhesives, and the like may also be employed. A cooperating mechanism is provided to any of the card engagement mechanisms described herein.

As noted above, the connector mechanisms for body 300 may be substantially similar to those for body 100 or 200, including bulldog clips, key rings, D-rings, pins, j-hooks and the like. These mechanisms may exert biasing force against a card or other object inserted therein.

The connectors, including the connector body and card engagement mechanisms may be made of any appropriate material or combination of materials. In some instances, metals (including but not limited to steel, aluminum, and the like) provide both durability and aesthetics. Polymeric materials and plastics allow for low cost materials and manufacturing advantages (e.g., molding techniques) that may not be feasible with metals.

Badge or identification card 140 may be attached directly to the assembly as described above. In some embodiments, a sleeve or holder may be integrated with the assembly.

The foregoing embodiments provide a lanyard and badge connector that is easy to use and cost effective to manufacture. The use of angled, laterally spaced points of attachment for the ribbon provide resistance to twisting of the lanyard and flipping of the card. While separate embodiments are described above, it will be understood that certain features from one may be applied to the other embodiments.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A lanyard and object connecting assembly comprising a first half shell member having a pair of tapering sidewalls terminating in a pair of shoulders defining a lanyard opening across a top edge of the first half shell member;

a second half shell member having a pair of engagement posts defining a lanyard opening across a top edge of the second half shell member;

at least one transverse support wall disposed across a middle portion on either the first half shell member or the second half shell member and at least one corresponding groove to receive the transverse support wall formed on the other of the first half shell and the second half shell;

wherein the first and second half shell members engage in a snap-fitted connection in which the engagement posts are captured by at least one of the sidewalls to form a slot defined by two transversely opposed, angled sidewalls, said slot sized to receive opposing ends of an optional lanyard ribbon without overlapping and each sidewall is oriented to serve as an edge guide for the opposing ends so as to impart an angle therebetween; and wherein a plurality of gripping cones are provided on at least one of the first half shell member and the second half shell member and formed so as to capture the lanyard ribbon when the first and second half shell members are engaged.

2. The assembly of claim 1 wherein the slot is further defined by inner facings of the shoulders and engagement posts on opposing sides of the lanyard opening.

3. The assembly of claim 1 wherein the angle is at least 5 degrees.

4. The assembly of claim 3 wherein the angle is 20 degrees.

5. The assembly of claim 1 wherein the at least one transverse support wall is parallel to the top edge of the first half shell member or the second half shell member.

6. The assembly of claim 1 wherein the at least one transverse support wall adjoins the sidewalls to define an upper chamber and a lower chamber of the lanyard assembly, wherein the lanyard ribbon is retained within the upper chamber.

7. The assembly of claim 1 wherein the transverse support wall is formed on the first half shell member and the corresponding groove is formed on the second half shell member.

8. The assembly of claim 1 further comprising an object connector mechanism connected with at least one of the first and second half shell members.

9. The assembly of claim 8 wherein the object connector mechanism is selected from a bulldog clip, a j-hook clip, a D-ring, a pin, and a key ring.

10. The assembly of claim 8 wherein the object connector protrudes at least partially through an aperture formed on a rear of the lanyard assembly.

* * * * *